US006041859A

United States Patent [19]

Blades

[11] Patent Number: 6,041,859

[45] Date of Patent: Mar. 28, 2000

[54] ANTI-ROTATION DEVICE

[75] Inventor: Brian Hunter Blades, Sugar Land, Tex.

[73] Assignee: Kuaefner Oilfield Products, Houston, Tex.

[21] Appl. No.: 09/001,229

[22] Filed: Dec. 30, 1997

[51] Int. Cl.[7] ..... E21B 33/04

[52] U.S. Cl. ..... 166/208; 166/209; 166/382

[58] Field of Search ..... 166/208, 209, 166/211, 212, 382, 387, 181

[56] References Cited

U.S. PATENT DOCUMENTS

| | | | |
|---|---|---|---|
| 3,739,846 | 6/1973 | Beson | 166/89 |
| 3,965,977 | 6/1976 | Beson | 166/88 |
| 4,653,589 | 3/1987 | Alandy | 166/382 |
| 4,703,774 | 11/1987 | Seehausen | 137/614 |
| 4,709,725 | 12/1987 | Morrison | 137/614 |
| 4,796,922 | 1/1989 | Prichard | 285/26 |
| 4,823,871 | 4/1989 | McEver et al. | 166/208 X |
| 4,852,611 | 8/1989 | Knerr et al. | 137/595 |
| 5,069,288 | 12/1991 | Singeetham | 166/348 |
| 5,620,052 | 4/1997 | Turner | 166/348 |
| 5,735,344 | 4/1998 | Duncan | 166/208 X |
| 5,823,254 | 10/1998 | Dobson et al. | 166/51 |

FOREIGN PATENT DOCUMENTS

| | | |
|---|---|---|
| 2097885 | 11/1982 | United Kingdom . |
| 2132728 | 7/1984 | United Kingdom . |
| 2184508 | 6/1987 | United Kingdom . |
| 2195158 | 3/1988 | United Kingdom . |

*Primary Examiner*—Frank Tsay
*Attorney, Agent, or Firm*—Wendy K. Buskop; Bayko Gibson et al

[57] ABSTRACT

An anti-rotation device for use with concentric tubing hangers is disclosed. The anti-rotation device can be used as part of the emergency release system that provides for manually releasing and removing the tubing hanger running tool in the event the hydraulic release mechanism fails. The anti-rotation device can be retrofitted into existing tubing hangers without modification to the surrounding casing or spool body.

17 Claims, 6 Drawing Sheets

ANTI-ROTATION DEVICE

SPECIFICATION

The invention relates to an anti-rotation device that can be used to unlock a tubing hanger from a wellhead/spool body assembly in the field so it may be retrieved.

BACKGROUND OF THE INVENTION

A variety of mechanical tools are positioned and released hydraulically. These tools also provide for some type of mechanical release in the event of a hydraulic failure. Mechanical releases in generally cylindrical tools may employ a set of left hand threads that when engaged back the tool off of the device to which it was attached. In order to engage the left hand threads while the device remains stationary, the tool depends on friction acting on the device to create enough torque to allow the left hand threads to engage and back the tool out of the device.

Current oilfield technology provides a hydraulically operated tubing hanger running tool to lock and unlock a tubing hanger into a spool body force subsea wellhead. In emergency situations, when the running tool hydraulic system has failed such as by a blown seal or leak in the system and the tubing hanger running tool needs to be pulled. It is desirable to pull only the tubing hanger running tool and not the surrounding spool body and/or well casing and leaving the tubing hanger in place. A device that achieves this end would be highly desirable and less costly than current technology. Once the tubing hanger running tool has be retrieved, then a mechanical retrieval tool can be used to further pull the tubing hanger, if necessary.

Mechanically actuated releases for tubing hanger running tools rely on the friction and or shear weight of the tubing depending from the tubing hanger to supply sufficient torque to turn the tubing hanger running tool and actuate a set of left hand threads to back out the tool. However, there are several applications where the tubing is too light to create enough torque or the well is a directional well and the tubing bends and relieves the friction placed on the tubing hanger. In these situations, it is extremely difficult if not impossible to mechanically retrieve the running tool from the tubing hanger.

Another aspect of mechanically retrieving a tubing hanger and tubing hanger running tool is cost. It is very costly to retrofit an existing well completion system with a mechanical release because the casing string and/or spool body would need to be modified. The type of modification required, would necessarily have to be done when the spool body or casing is manufactured. It would be very beneficial to have a mechanical release system that can be installed in the tubing hanger without modifying the existing casing or spool body.

OBJECTS OF THE INVENTION

It is an object of the present invention to provide an anti-rotation device that can be used to mechanically unlock a tubing hanger so it may be retrieved.

It is another object of the present invention to provide an anti-rotation device that can be retrofitted into existing tubing hangers.

It is yet another object of the present invention to provide a mechanical method for retrieving a tubing hanger running tool and tubing hanger where the conventional hydraulic retrieval system has failed.

SUMMARY OF THE INVENTION

The present invention relates to an anti-rotation device for use with concentric tubing hangers and side valve tree wellhead completion systems employing a spool body. The anti-rotation device can be used as part of the emergency release system that allows the tubing hanger running tool to be removed manually in the event of a hydraulic system failure. In that event, the anti-rotation device will allow the operator to rotate the tubing hanger running tool to the right and release it mechanically.

The anti-rotation device is installed in a cavity that is machined into the outer surface of a conventional tubing hanger, preferably in equally spaced groups of four. A locking dog or cam body rotates freely on a pin that is driven through the cam body. The pin also holds a bracket in place within a slot formed in the cam body. When the tubing hanger is rotated in a clockwise direction, the cam body is biased outward radially toward the casing and engages the casing preferably with a gripping means. The surrounding casing does not require any preparation to use the anti-rotation device, therefore the device can be used with existing casing.

In operation, the cam body rotates counterclockwise about the pin which brings the gripping means into contact with the casing. As the tubing hanger is turned clockwise the anti-rotation device to rotates counterclockwise and engages the surrounding casing. As the tubing hanger is rotated at the upper end, it is restrained at its lower end and the continued clockwise rotation creates sufficient torque to shear a set of retaining pins and causes a left hand thread to move the tubing hanger running tool in an upward direction, releasing a split locking ring that holds the tubing hanger running tool on the tubing hanger. Then the tubing hanger running tool is pulled upwards and retrieved. The tubing hanger may then be retrieved if necessary.

DETAILED DESCRIPTION OF THE PREFERRED EMBODIMENTS

Figure 1:
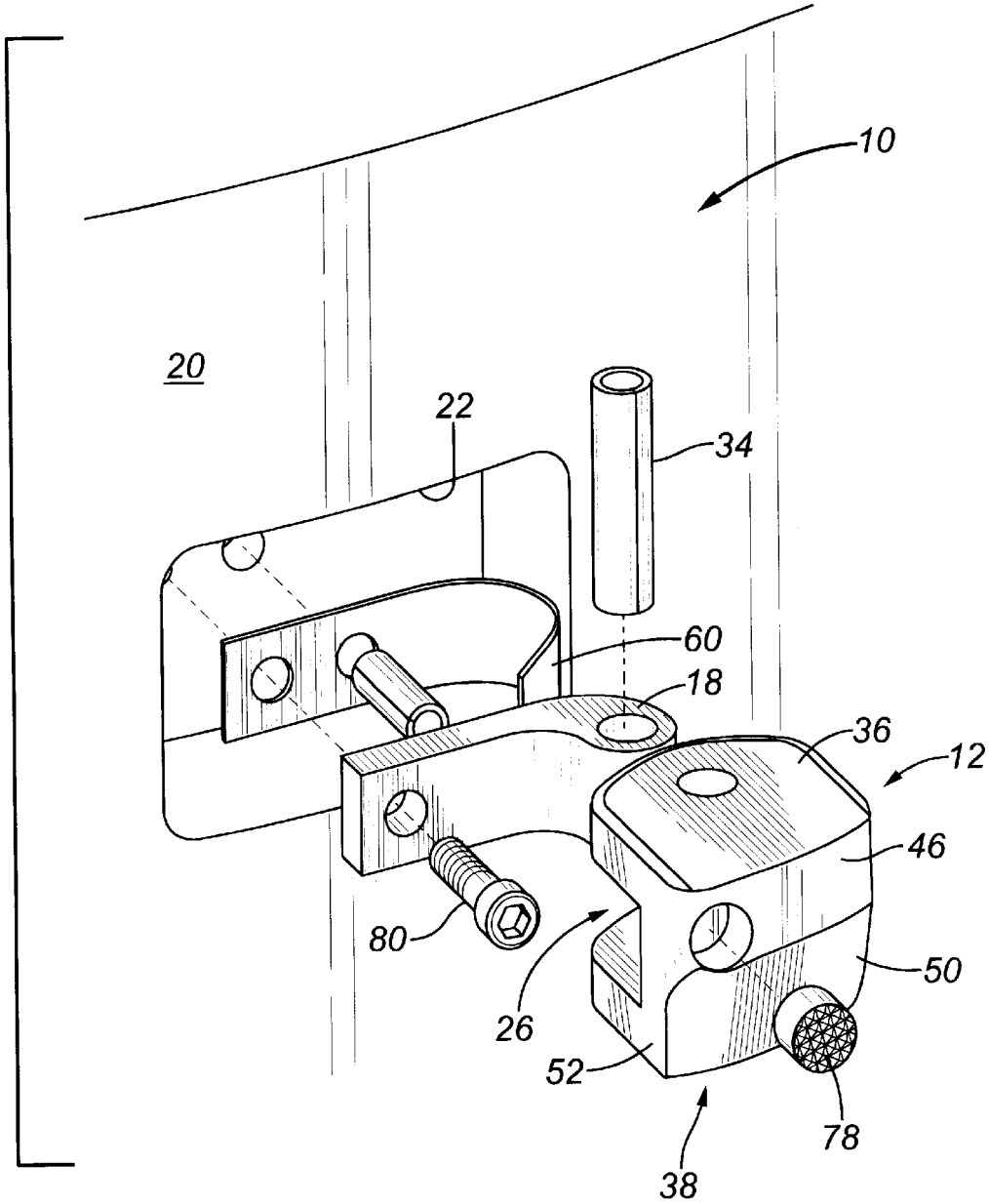
FIG. 1 is an exploded view of one embodiment of the invention.

The present invention relates to an anti-rotation device 10 for use in mechanically retrieving a tubing hanger that has lost hydraulic power. As shown in FIGS. 1–4, the apparatus comprises a cam body 12 having a longitudinal axis 14, bracket 18, and a means for receiving the bracket 26 (also termed herein as "slot"). The bracket 18 has one end pivotally attached to the cam body 12 and is received in the slot 26. The apparatus preferably includes a housing 20, which is an integral part of a tubing hanger. The housing 20 defines a cavity 22 therein for receiving the cam body 12. Preferably, there is a means for biasing 60 the cam body 12 out of the cavity 22. The cam body 12 is positioned inside the housing 20 and the means for biasing 60 is positioned between the housing 20 and the bracket 18. The means for biasing 60 can be a flat leaf spring.

Figure 2:
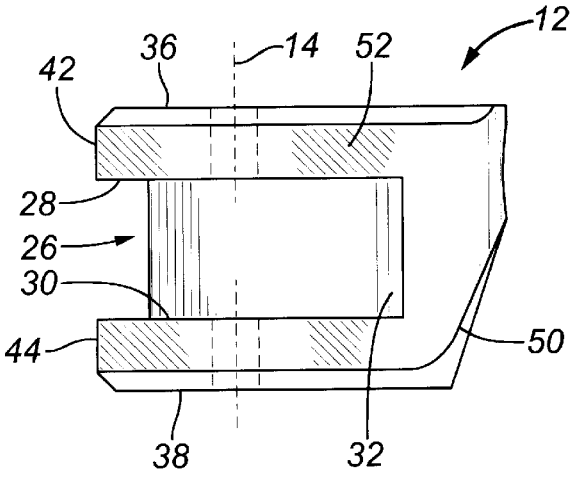
FIG. 2 is a side view of the cam body.

In a preferred embodiment, the cam body 12 defines a slot 26 therein (FIG. 2). The slot 26 has a top wall 28, a bottom wall 30 and a side wall 32 connecting the top wall 28 to the bottom wall 30. The bracket 18 can be held in the slot 26 by a pin 34 shown in FIG. 1. The pin 34 is positioned along axis 14 through the slot 26 shown in FIG. 2 along the longitudinal axis of the cam body 12. The bracket 18 is pivotally attached to the cam body 12 by the pin 34 (FIG. 1).

Figure 3:
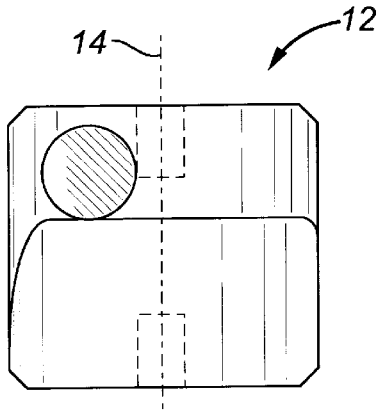
FIG. 3 is a front view of the cam body.
Figure 4:
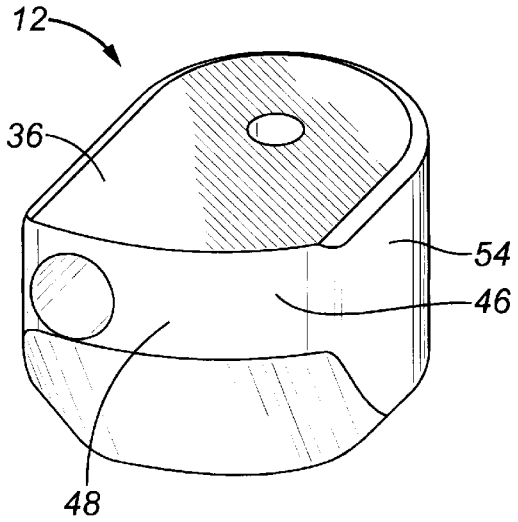
FIG. 4 is a top view of the cam body.
Figure 5:
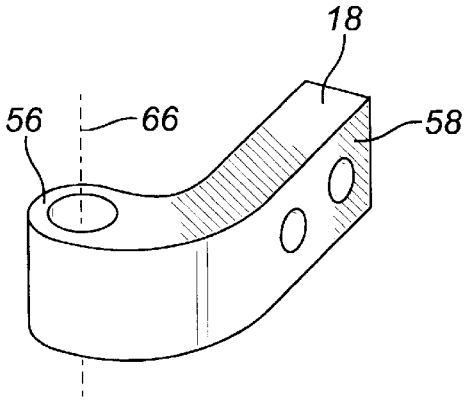
FIG. 5 is a pictorial view of the bracket.

Preferably, the cam body 12 is designed so that it fits into the cavity 22 defined by the tubing hanger. The design is such that the cam body 12 will fit into the cavity 22 as the tubing hanger is lowered into a spool body of a subsea wellhead (not shown). The cam body 12 preferably has a first generally planar end surface 36 (FIG. 4) positioned normally to the longitudinal axis 14 as shown in FIG. 2 and 5. A second generally planar end surface 38 shown in FIG. 2 and 3 is positioned normally to the longitudinal axis 14 and generally parallel and spaced apart from the first generally planar end surface 36. A generally cylindrical surface 46 (FIG. 1 and 4) is positioned generally parallel to the longitudinal axis 14 and radiused about the longitudinal axis 14. The generally cylindrical surface 46 has a first generally cylindrical portion 42 shown in FIG. 2 adjacent to the first generally planar end surface 36 and a second generally cylindrical portion 44 also shown in FIG. 2 adjacent to the second generally planar end surface 38. A slot 26 like that described above is formed between the first generally cylindrical portion 42 and the second generally cylindrical portion 44. The slot 26 is oriented in a plane parallel to the first generally cylindrical portion 42 and the second generally cylindrical portion 44 and extending into the first generally cylindrical portion 42 to a depth greater than the longitudinal axis 14.

As shown in FIG. 2 an arcuate surface 42 is adjacent to the generally planar end surface 36 and an arcuate surface 44 is adjacent to the generally planar end surface 38. Said arcuate surfaces 42 and 44 are radiused about the longitudinal axis 14 and are positioned on either side of slot 26.

Figure 7:
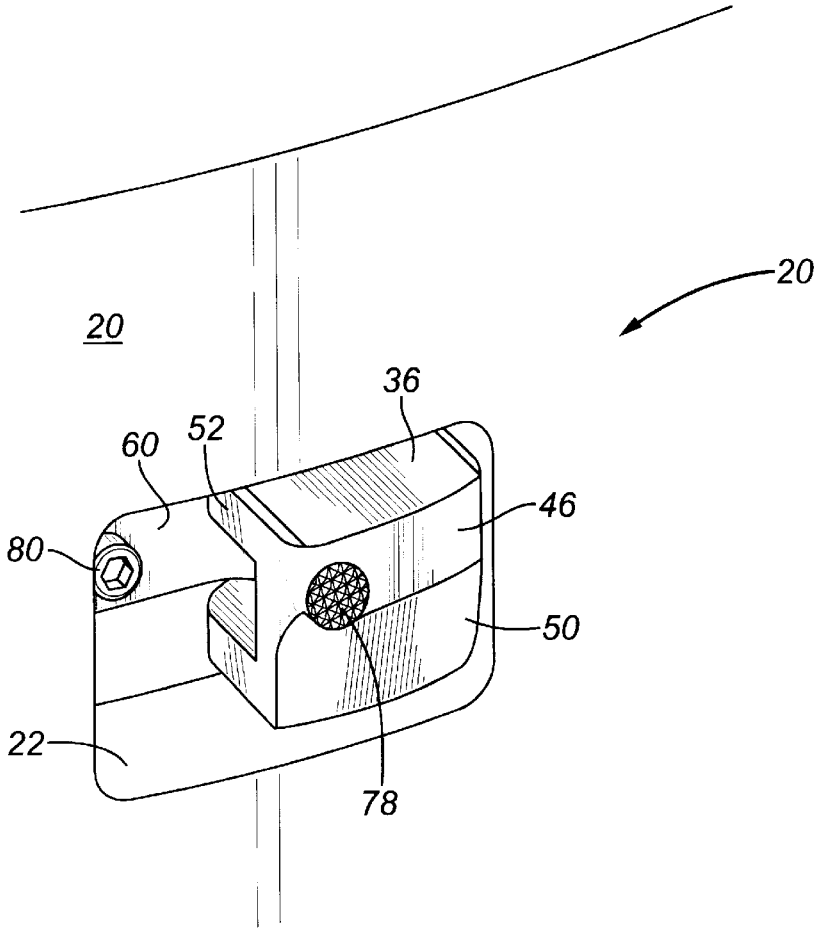
FIG. 7 is a front view of the cam body in the tubing hanger.

As shown in FIG. 7 a generally frustoconical portion 50 is radiused about the longitudinal axis 14 and converges from the generally cylindrical surface 46 to a first generally planar end surface 38. A first generally planar sidewall 52 as shown in FIG. 7 is bounded by the first end surface 36, the second end surface 38, (shown in FIG. 2) the generally cylindrical surface 46 and the generally frustoconical portion 50 as shown in FIG. 4. A generally planar sidewall 54 (shown in FIG. 4) is positioned generally parallel to the first planar sidewall 52 as shown in FIG. 2 and bounded by the first end surface 36, and the second end surface 38 in FIG. 2, the general cylindrical surface 46 (FIG. 4) and the generally frustoconical surface 50 (FIG. 2).

Preferably, the generally planar sidewall 52 is longer than the generally planar sidewall 54. The slot 26 opens into the generally planar sidewall 52. The slot 26 does not open into the generally planar sidewall 54. The slot 26 extends to near the generally frustoconical portion 50.

In FIG. 5, a preferred embodiment, the bracket 18 has a first end 56 and a second end 58. The first end 56 of the bracket has a vertical axis 66 that is parallel to and coaxially aligned with the longitudinal axis 14 of the cam body 12. The first end 56 of the bracket 18 is pivotally attached to the cam body 12 and the second end 58 of the bracket 18 is fixedly attached to the housing 20 so that the cam body 12 rotates about the vertical axis 66 of the first end 56 of the bracket 18.

Figure 6:
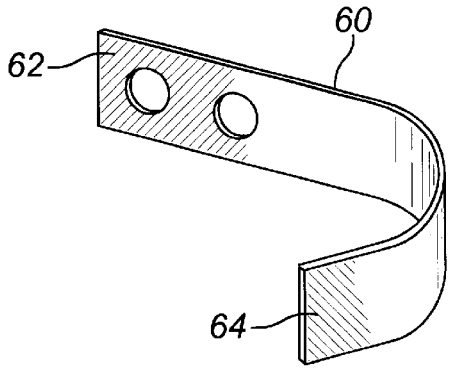
FIG. 6 is a pictorial view of the spring means.

In FIGS. 6 and 1, shown is the preferred biasing means 60. The biasing 60 means comprises a flat leaf spring means having a first end 62 that is fixed to the housing 20 between the housing 20 and end 58 of the bracket 18, and a second end 64 that is positioned adjacent to the side wall of the slot 26. The preferred spring means 60 has an arcuate shape as shown in FIGS. 1 & 6.

Figure 8:
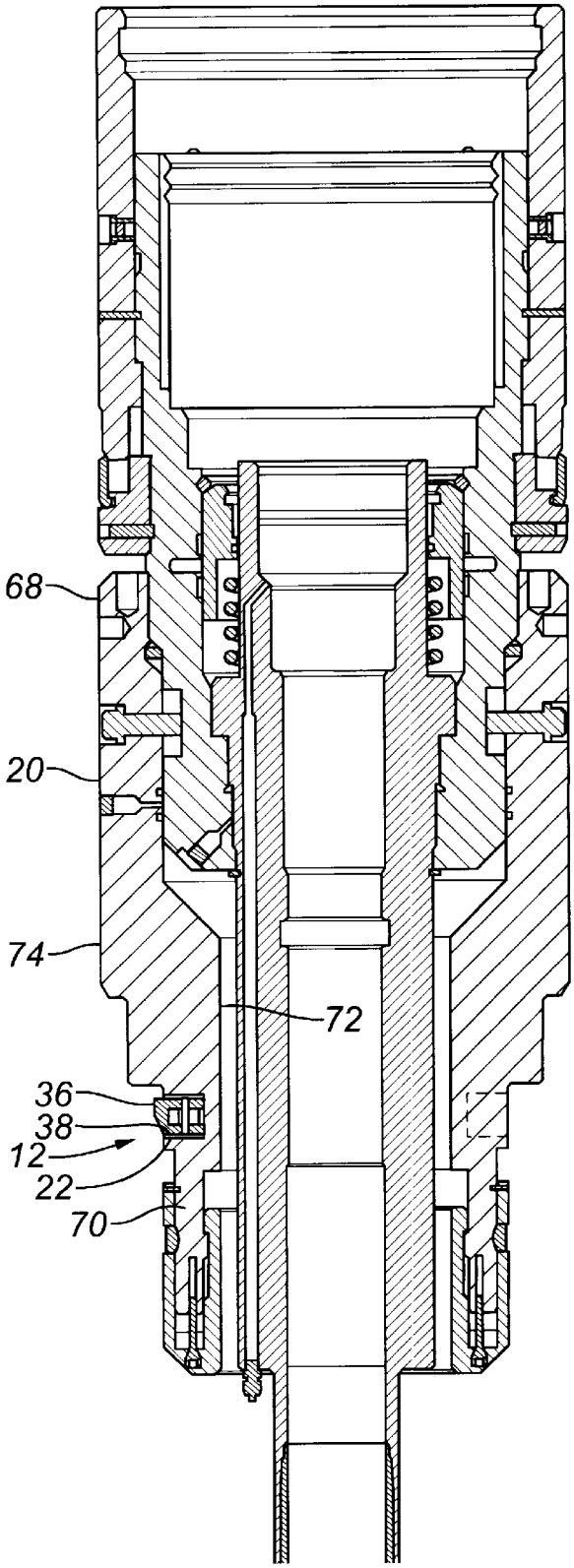
FIG. 8 is sectional view of a tubing hanger with one embodiment of the present invention.

Preferably, the housing 20 comprises a generally cylindrical tubing hanger having an upper first end 68, a lower end 70, an inside surface 72 defining an inside diameter and an outside surface 74 defining an outside diameter (FIG. 8). The generally cylindrical tubing hanger defines the cavity 22 in the outside surface 74, the cavity 22 being sized to receive the cam body 12. The cam body 12 is received in the cavity 22 formed in the tubing hanger so that the first generally planar end surface 36 of the cam body 12 faces the first end 68 of the tubing hanger. The second generally planar end surface 38 faces the second end 70 of the tubing hanger and the frustoconical portion 50 (as shown in FIG. 1) is adjacent to the outer surface of the tubing hanger. This position of the cam with the frustroconical portion 50 facing downward toward lower 70 allows the cam body 12 to pass smoothly into the spool body and casing without catching on anything that may be protruding.

Figure 10:
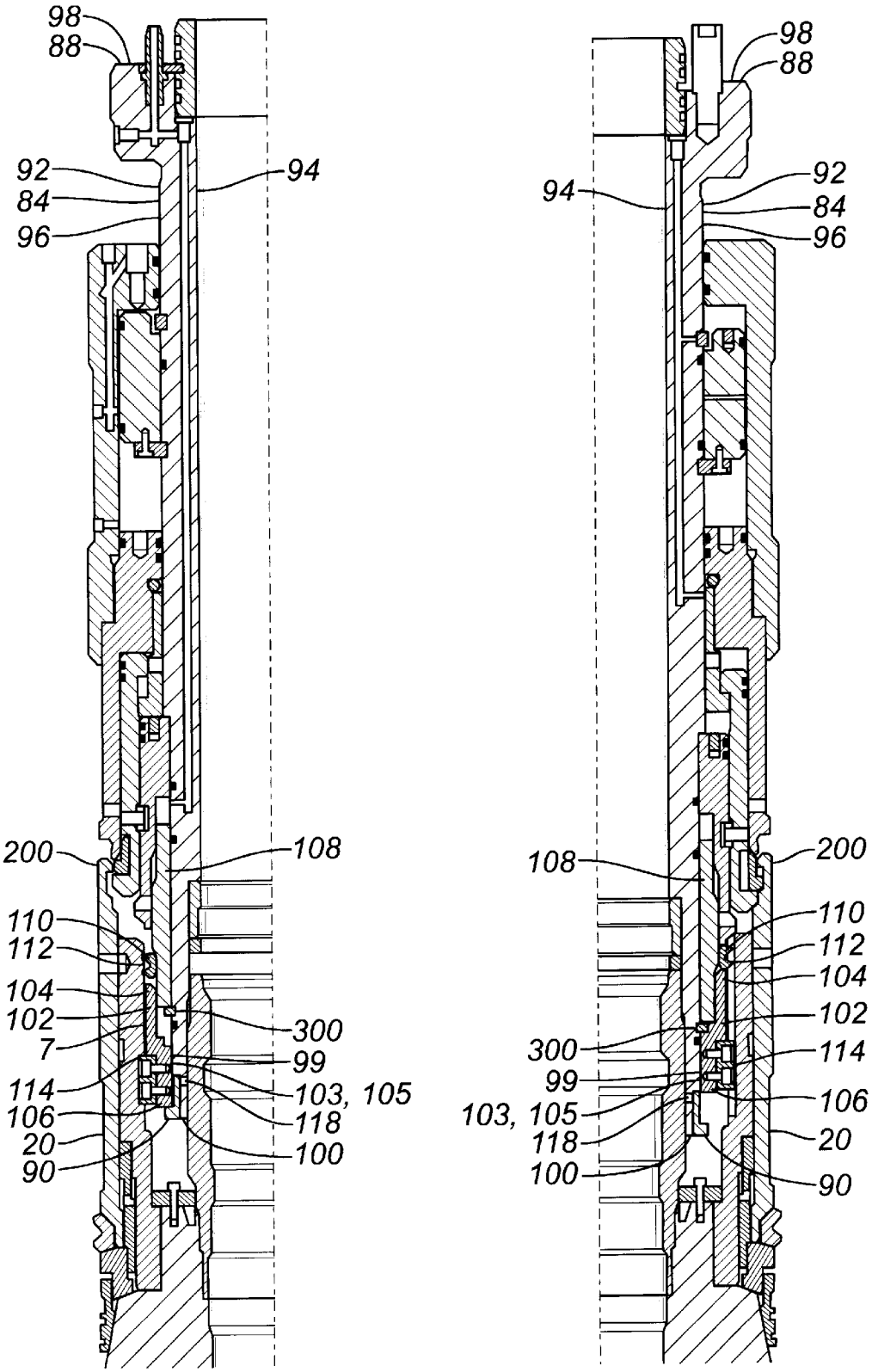
FIG. 10 is a sectional view of the tubing hanger running tool showing the top portion (A) in a disengaged position and the lower portion (1) in an engaged position.

In use, the tubing hanger running tool 84 has an upper end 88 and a lower end 90 that is engagably received by the actuating ring 200 of the upper end of the tubing hanger body 20. The running tool 84 has a generally cylindrical body 92 having an inside surface 94 and an outside surface 96, an upper end 98 and a lower end 100. The outside surface 96 of the body defines left-hand threads 99 near the lower end 100. A generally cylindrical actuation sleeve 102 is positioned near the lower end of the body 92. The actuation sleeve 102 has an upper end 104, a lower end 106, and an inside surface 103 that defines left hand threads 105 near the lower end 106. The left-hand threads 105 are complementary to and engaged with the left hand threads 99 defined by the outside surface 96 of the body 92. The running tool 84 further comprises a hydraulic piston 108 that is positioned between to the outside surface 96 of the body 92 and the inside surface 103 of the actuation sleeve 102. The piston 108 moves from an engaged position to a disengaged position. (See FIG. 10).

During normal operation, the lower end of the running tool is positioned inside the upper end of the tubing hanger and the piston is actuated to an engaged position. When the piston is in an engaged position, it pushes a split lock ring 110 outwardly so that is engages the inside surface of the tubing hanger, locking the running tool onto the tubing hanger. The split lock ring 110 has an outside profile 112 that matches a profile formed on the inside surface of the tubing hanger 20. (FIG. 10) The profile of the split lock ring is not a novel feature of the present invention and can be modified to fit a particular vendor's tubing hanger. The running tool is restrained from rotational movement by a key 114 that is attached to the outside surface of the actuation sleeve 102. The tubing hanger receives the key 114 in a slot (not shown) machined into the inside surface of the tubing hanger.

In a situation where the hydraulic system has failed, the running tool can be removed mechanically from the concentric tubing hanger. The running tool is rotated clockwise which in turn rotates the tubing hanger in a clockwise direction. This rotational movement causes the cam body 12 to pivot outwardly and engage the inside surface of the casing. Thus the lower end of the tubing hanger is restrained from movement using this device. The left-hand threads on the actuation sleeve and the inside surface of the body begin to rotate the body of the running tool in an upward direction. This upward movement causes a shear ring 118 to break and allows the body of the running tool to continue to move upward. The piston 108 is manually moved upward as well, causing the split lock ring 110 to move to a disengaged position. Once the split lock ring has moved to a disengaged position, the running tool can be pulled out, leaving the tubing hanger locked into its installed position. Then a mechanical running and retrieval tool can be used to retrieve the tubing hanger if necessary.

Figure 9:
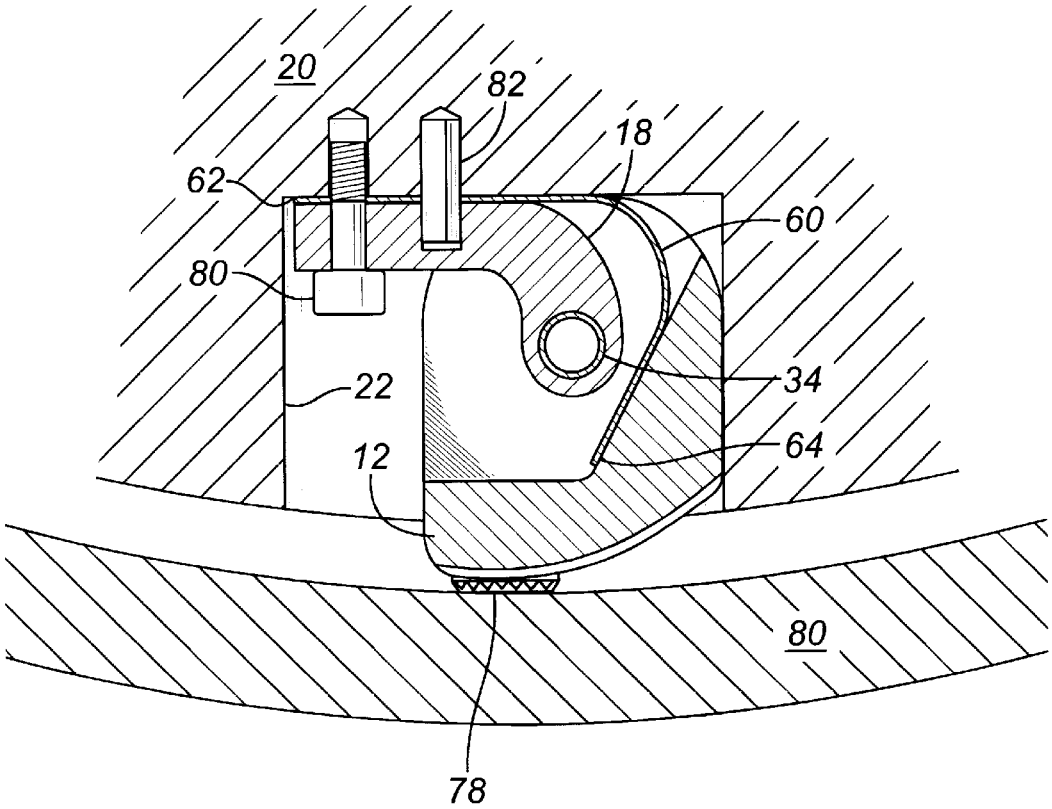
FIG. 9 is a sectional view taken along cut lines B—B in FIG. 8.

The cam body 12 is in a first extended position when cam body 12 is rotated in a fully counter-clockwise direction relative to the longitudinal axis 14 and the arcuate surface 46 is outside the cavity 22 beyond the outside surface of the tubing hanger (FIG. 9).. The cam body 12 is in a second position when the cam body 12 is rotated in a clockwise direction and the arcuate surface 46 inside the cavity 22.

Preferably, there is a gripping means 78 positioned in the arcuate side surface of cam body 12. The gripping means 78 engages the inside surface of the casing in order to hold the lower end of the tubing hanger in a stationary position.

In another embodiment of the present invention, there is provided, a method for mechanically disengaging a tubing hanger running tool or any generally cylindrical tool from a first generally tubular member such as a tubing hanger. The sleeve can be a first generally tubular member such as casing or spool body as described above. The tubing hanger running tool has a first end, a second end, an inside surface and an outside surface. The tubing hanger is positioned inside the sleeve. The sleeve is in turn fixed to a wellhead. The method consists of providing a tubing hanger having at least one cavity machined in the outside surface for receiving a cam body. A cam body like the one described above is positioned in the cavity. Once in place inside the casing, the tubing hanger is rotated in a first rotational direction (preferably clockwise) so that the cam body rotates out of the cavity in a second rotational direction (preferably counterclockwise) and the side surface of the cam body contacts the inside surface of the sleeve.

In order to provide more friction against the inside surface of the casing, a gripping means is positioned on the contacting surface, so that when the tubing hanger is rotated in a first rotational direction, the gripping means will grip the inside surface of the casing sleeve. Preferably, enough torque is created to separate the tool from the first tubular member without separating the tubing hanger from the sleeve. The tubing hanger can then subsequently be removed if the need arises.

What is claimed is:

1. An antirotation apparatus for use in a tubing hanger to fasten to said tubing hanger and to unlock a tubing hanger running tool comprising a bracket:

a cam body having a longitudinal axis and a means for receiving the bracket;

the bracket having one end pivotally attached to the cam body, said bracket being disposed between said means for receiving the bracket and a means for biasing, wherein said means for biasing is secured to a housing which is secured to the tubing hanger;

said housing further defining a cavity therein for receiving said cam body;

said means for biasing arranged to position the cam body out of said cavity, wherein said cam body is positioned inside said housing.

2. An apparatus as in claim 1, wherein said cam body defines a slot therein, said slot having a top wall, a bottom wall and a side wall connecting the top wall to the bottom wall.

3. An apparatus as in claim 2, further comprising a pin positioned in the slot along the longitudinal axis of the cam body, said bracket being pivotally attached to the cam body by said pin.

4. An apparatus as in claim 2, wherein said cam body has a first generally planar end surface positioned normally to the longitudinal axis, a second generally planar end surface positioned normally to the longitudinal axis and generally parallel and spaced apart from the first generally planar end surface, a generally cylindrical surface positioned generally parallel to the longitudinal axis and radiused about said longitudinal axis and having a first generally cylindrical portion adjacent to the first generally planar end surface and a second generally cylindrical portion adjacent to the second generally planar end surface, wherein the slot is formed in the generally cylindrical surface between the first generally cylindrical portion and the second generally cylindrical portion, said slot being oriented in a plane perpendicular to the first generally cylindrical portion and the second generally cylindrical portion and extending into the first generally cylindrical portion to a depth greater than the longitudinal axis, an arcuate surface positioned across the longitudinal axis from the generally cylindrical surface, said arcuate surface having a generally cylindrical portion radiused about the longitudinal axis positioned adjacent to the first generally planar end surface and extending generally normally to said first generally planar end surface;

a generally frustoconical portion radiused about the longitudinal axis and converging from the generally cylindrical portion of said arcuate surface to the second generally planar end surface;

a first generally planar sidewall bounded by the first end surface, the second end surface, the generally cylindrical surface, and the generally arcuate surface; and a second generally planar sidewall positioned generally parallel to the first generally planar sidewall and bounded by the first end surface, the second end surface, the generally cylindrical surface, and the generally arcuate surface.

5. An apparatus as in claim 4, wherein said first generally planar sidewall is longer than said second generally planar sidewall.

6. An apparatus as in claim 4, wherein said slot opens into said first generally planar sidewall.

7. An apparatus as in claim 4, wherein said slot does not open into said second generally planar sidewall.

8. An apparatus as in claim 4, wherein said slot extends to near said arcuate surface.

9. An apparatus as in claim 2, wherein the bracket has a first end and a second end, wherein the first end of the bracket has a vertical axis that is parallel to and coaxially aligned with the longitudinal axis of the cam body, wherein the first end of the bracket is pivotally attached to the cam body and the second end of the bracket is fixedly attached to the housing so that the cam body rotates about the vertical axis of the first end of the bracket.

10. An apparatus as in claim 9, wherein the biasing means comprises a flat leaf spring means having a first end that is fixed to the housing between the housing and the second end of the bracket, and a second end that is positioned adjacent to the side wall of the slot, said spring means having an arcuate shape.

11. An apparatus as in claim 1, wherein the housing is attached to a generally cylindrical tubing hanger having a first end, a second end, an inside surface defining an inside diameter and an outside surface defining an outside diameter, wherein the generally cylindrical tubing hanger defines said cavity in the outside surface, said cavity being sized to receive said cam body.

12. An apparatus as in claim 11, wherein the cam body is received by the tubing hanger so that the first generally planar end surface of the cam body faces the first end of the tubing hanger, the second generally planar end surface faces the second end of the tubing hanger and the frustoconical portion is adjacent to the outer surface of the tubing hanger.

13. An apparatus as in claim 2, further comprising a gripping means positioned in the inside surface of the tubing hanger.

14. A method for mechanically disengaging a generally cylindrical tool having an outside surface and an inside surface, from a first generally tubular member having a first end, a second end, an inside surface and an outside surface, wherein said first generally tubular member is positioned inside a second generally tubular member having an inside surface and an outside surface, said method comprising:

positioning a cam body inside a slot machined into the outside surface of said first generally tubular member, wherein said cam body includes a means for biasing said cam body out of the slot and away from said first generally tubular member;

rotating said generally cylindrical tool in a first rotational direction which in turn rotates the first generally tubular member so that the cam body rotates out of the slot in a second rotational direction which is opposite the first rotational direction; and contacting a face on the cam body with the inside surface of the second generally tubular member.

15. The method of claim 14, further comprising positioning a gripping means on a contacting face of the cam body, so that when the first generally tubular member rotates in the second rotational direction, the gripping means will grip the inside surface of the second generally tubular member.

16. The method of claim 14, further comprising creating sufficient torque to mechanically separate the generally cylindrical tool from the first tubular member without separating the first tubular member from the second tubular member.

17. The method of claim 16, further comprising mechanically removing the first generally tubular member from the second generally tubular member.

* * * * *

UNITED STATES PATENT AND TRADEMARK OFFICE

CERTIFICATE OF CORRECTION

PATENT NO. : 6,041,859
DATED : March 28, 2000
INVENTOR(S) : Blades

It is certified that error appears in the above-identified patent and that said Letters Patent is hereby corrected as shown below:

Title page,
Item [73], please delete "Kuaefner", and insert --Kvaerner -- therefore.

Signed and Sealed this

Eleventh Day of December, 2001

*Attest:*

Nicholas P. Godici

NICHOLAS P. GODICI
*Acting Director of the United States Patent and Trademark Office*

*Attesting Officer*